US009290357B2

(12) United States Patent
Mays et al.

(10) Patent No.: US 9,290,357 B2
(45) Date of Patent: Mar. 22, 2016

(54) APPARATUS FOR DEPLOYING AND RETRIEVING HOSE

(71) Applicant: Polypipe Handling Specialists, Inc., Edmond, OK (US)

(72) Inventors: P. Mike Mays, Edmond, OK (US); Trevor J. Mays, Edmond, OK (US); Michael K. Mays, Edmond, OK (US)

(73) Assignee: Polypipe Handling Specialists, Inc., Edmond, OK (US)

( * ) Notice: Subject to any disclaimer, the term of this patent is extended or adjusted under 35 U.S.C. 154(b) by 152 days.

(21) Appl. No.: 14/173,564

(22) Filed: Feb. 5, 2014

(65) Prior Publication Data

US 2015/0217967 A1 Aug. 6, 2015

(51) Int. Cl.

| | |
|---|---|
| ***B65H 23/188*** | (2006.01) |
| ***B65H 75/42*** | (2006.01) |
| ***B65H 75/44*** | (2006.01) |
| ***B65H 59/16*** | (2006.01) |
| ***B65H 67/00*** | (2006.01) |

(52) U.S. Cl.

CPC ..... *B65H 75/425* (2013.01); *B65H 59/16* (2013.01); *B65H 67/00* (2013.01); *B65H 75/4481* (2013.01); *B65H 2701/332* (2013.01)

(58) Field of Classification Search

CPC ..... B65H 75/425; B65H 75/4481
USPC ..... 242/419.5, 557, 403, 533.8
See application file for complete search history.

(56) References Cited

U.S. PATENT DOCUMENTS

| | | | | |
|---|---|---|---|---|
| 4,148,445 | A | 4/1979 | Reynolds et al. | |
| 4,586,677 | A | 5/1986 | Nevarez | |
| 5,083,722 | A | 1/1992 | Briggs et al. | |
| 5,454,431 | A | 10/1995 | Ledwig | |
| 5,897,073 | A * | 4/1999 | McVaugh | 242/399.1 |
| 7,143,971 | B2 | 12/2006 | Yoder et al. | |
| 7,431,267 | B1 | 10/2008 | Cunningham | |
| 7,566,024 | B2 | 7/2009 | Krise et al. | |
| 7,673,697 | B2 * | 3/2010 | Peterson | 172/19 |
| 7,793,881 | B1 * | 9/2010 | Torres | 242/532.6 |
| 2004/0227031 | A1 * | 11/2004 | Yoder et al. | 242/390.5 |
| 2010/0314482 | A1 * | 12/2010 | Merkt | 242/557 |
| 2012/0118397 | A1 | 5/2012 | Novotny et al. | |
| 2013/0168484 | A1 | 7/2013 | Novotny et al. | |

OTHER PUBLICATIONS

Frac Tank Deployment System (FTDS). (2013). Hippo Frac Tank. [Brochure]. Retrieved from www.sei-ind.com.

* cited by examiner

*Primary Examiner* — Sang Kim
(74) *Attorney, Agent, or Firm* — Dunlap Codding, P.C.

(57) ABSTRACT

An apparatus for retrieving a hose on a hose reel includes a base, a pair of opposed arms for supporting the hose reel, a tensioning assembly, and a drive assembly. Each of the arms having a reel support member near a distal end thereof, and the arms being moveable relative to one another between an engaged position wherein the arms are positioned so that the reel support members are supportingly engaged with a hub of a hose reel, and a non-engaged position wherein the arms are positioned so that the reel support members are disengaged from the hub. The drive assembly is supported by at least one of the first and second arms in a way that activation of the drive assembly causes at least one of the reel support members to rotate and thereby rotate the hose reel when the arms are in the engaged position.

11 Claims, 10 Drawing Sheets

APPARATUS FOR DEPLOYING AND RETRIEVING HOSE

BACKGROUND

Hydraulic fracturing is a process used in the oil and gas industry to stimulate the production rate of a well. The process involves injecting a high volume of fluid, such as water, down the well at a high pressure to cause the subterranean formation surrounding the well to fracture. Because oil and gas wells are often located in remote locations, one of the issues faced when performing hydraulic fracturing is how to effectively transport large quantities of fluid to the well site. One way of providing fluid is to transport the fluid in trucks to the well site. Due to the volume of fluid that may be required, this can be cost prohibitive. Another way of getting fluid to the well site is to pump the fluid through a conduit from a nearby source of fluid, such as a pond, lake, stream, or the like, to the well site.

Prior to initiating the pumping process, the conduit must be deployed from the well site to the source of fluid. In many instances, the distance from the fluid source to the well site may be several miles. In the past, polymer based piping and metal based piping have been used to form the conduit. However, in recent years collapsible lay-flat hose have been used. In the case of lay-flat hose, it is generally stored and transported to the well site on a reel. At the well site, the reel must be removed from the transport vehicle and unrolled along the ground to the fluid source. Due to the distance from the well site to the fluid source, multiple sections of hose may be required to be laid out and connected with one another in an end-to-end fashion. Once the requisite amount of fluid has been pumped from the fluid source, the hose sections must be disconnected from one another and rolled onto the reels for transport from the well site. Currently, deployment and retrieval of lay flat hose is a time consuming, and thus costly, process.

To this end, a need exists for an improved apparatus for deployment and/or retrieval of hose. It is to such apparatus that the inventive concepts disclosed herein are directed.

BRIEF DESCRIPTION OF THE DRAWINGS

The accompanying drawings, which are incorporated in and constitute a part of this specification, illustrate one or more implementations described herein and, together with the description, explain these implementations.

DETAILED DESCRIPTION OF EXEMPLARY EMBODIMENTS

Figure 1:
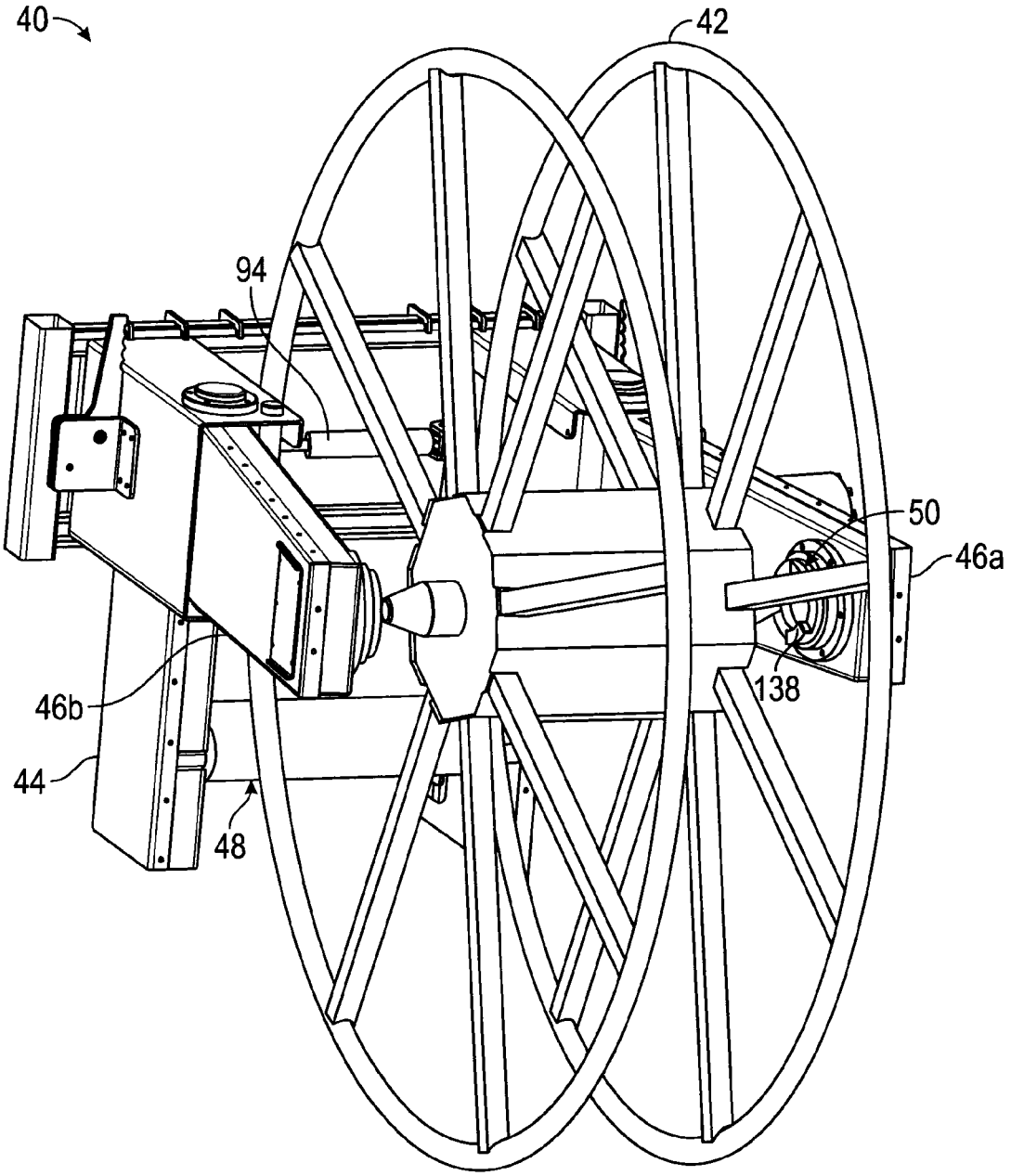
FIG. 1 is a perspective view of an apparatus constructed in accordance with the inventive concepts disclosed herein shown in a non-engaged position.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and more particularly to FIG. 1, an apparatus 40 constructed in accordance with the inventive concepts disclosed herein is illustrated. The apparatus 40 may be used for deploying and/or retrieving a hose, such a hose 41 depicted in FIG. 8. Broadly, the apparatus 40 may include a hose reel 42, a base 44, a pair of opposed arms

46*a*, 46*b* mounted to the base 44, a hose tensioning assembly 48 supported by the base 44, and a drive assembly 50.

Figure 2:
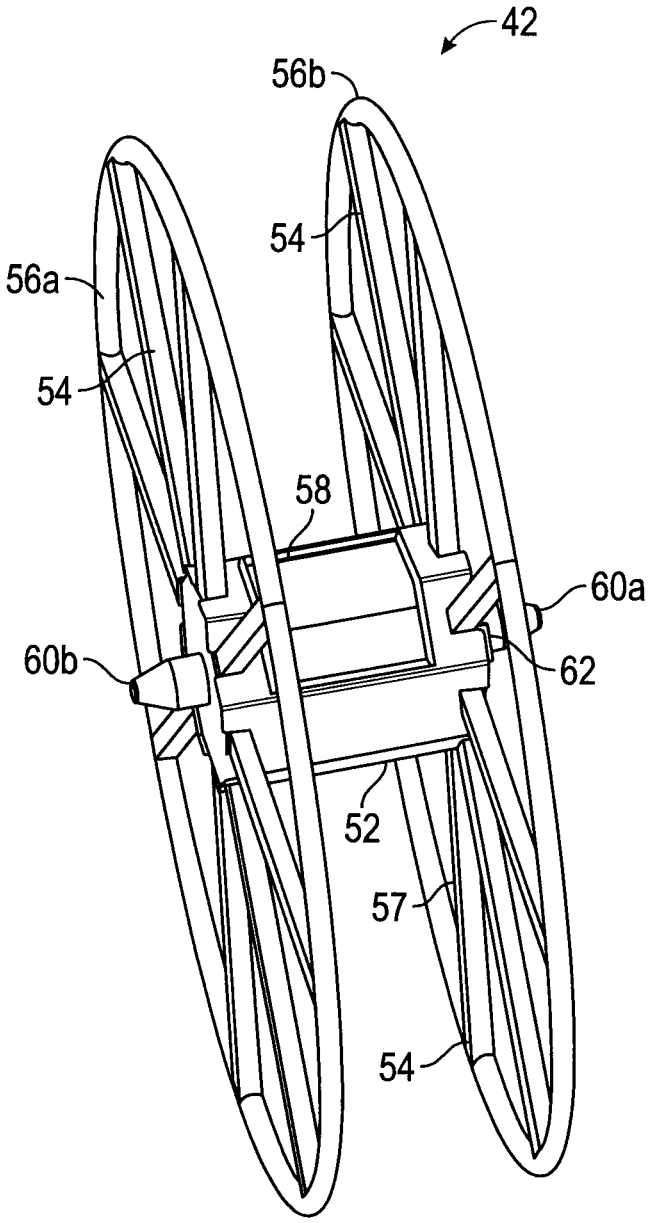
FIG. 2 is a perspective view of a hose reel.
Figure 3:
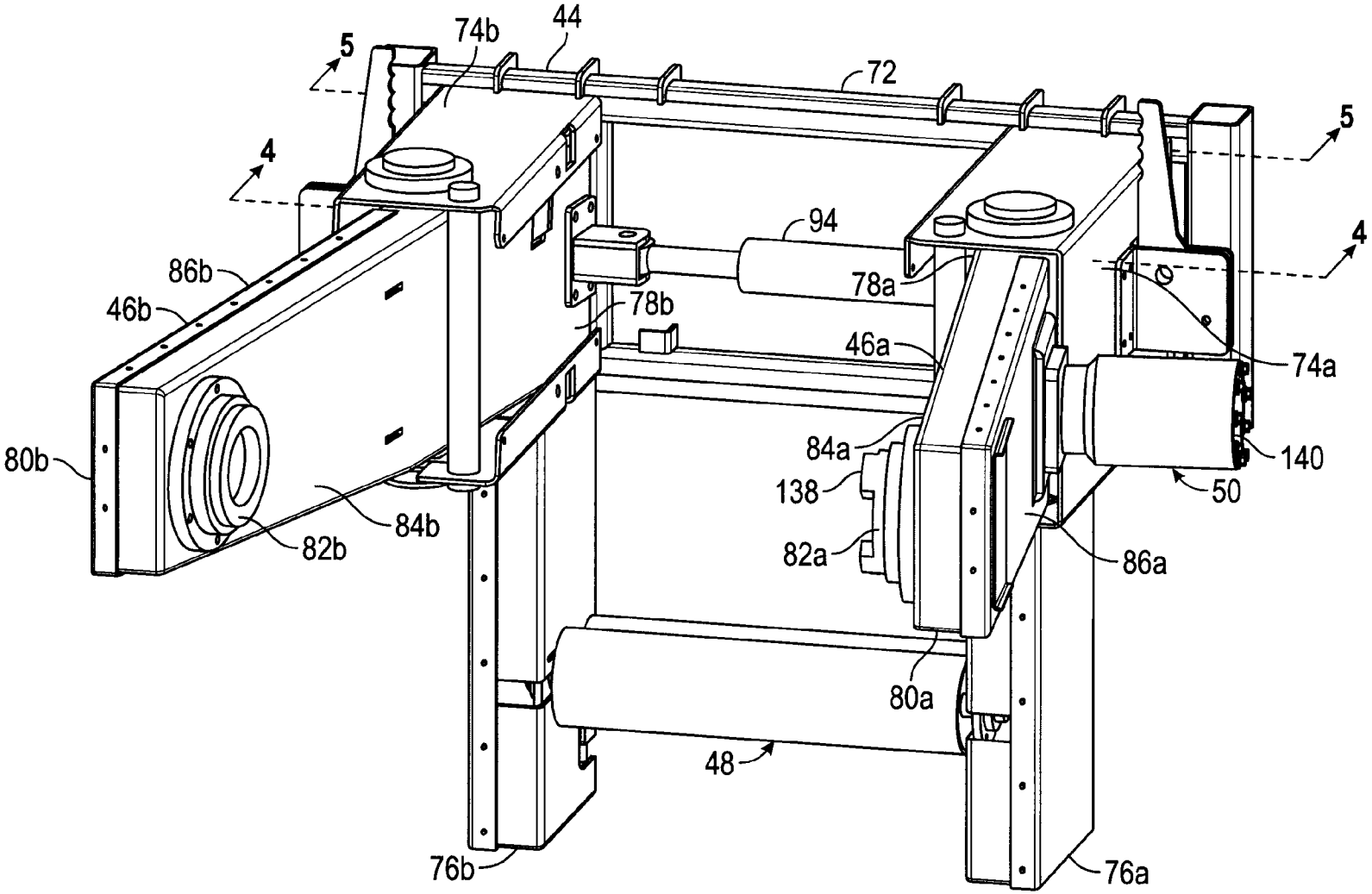
FIG. 3 is a front perspective view of the apparatus of FIG. 1.
Figure 8:
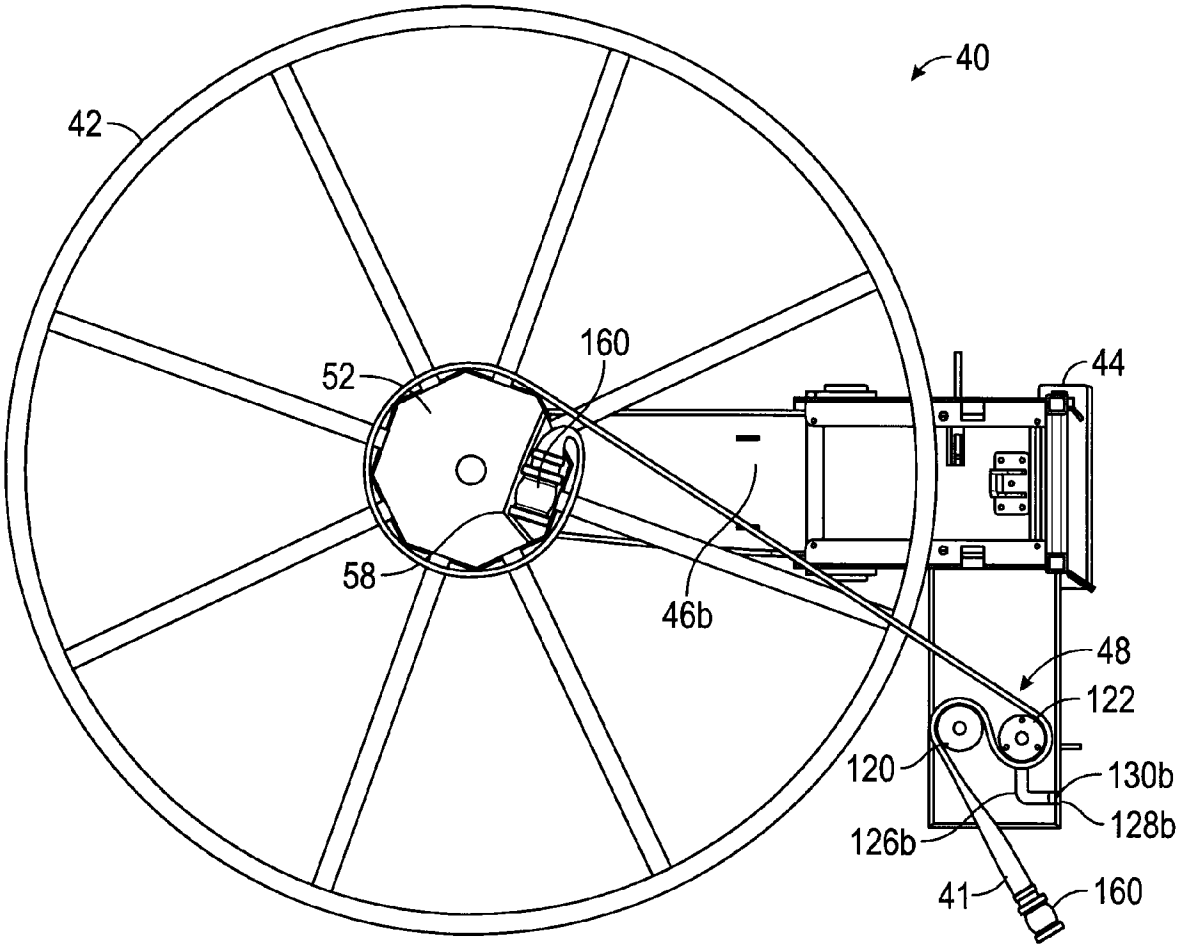
FIG. 8 is a sectional view of the apparatus illustrating a hose extending from the hose reel and through the tensioning assembly.
Figure 9:
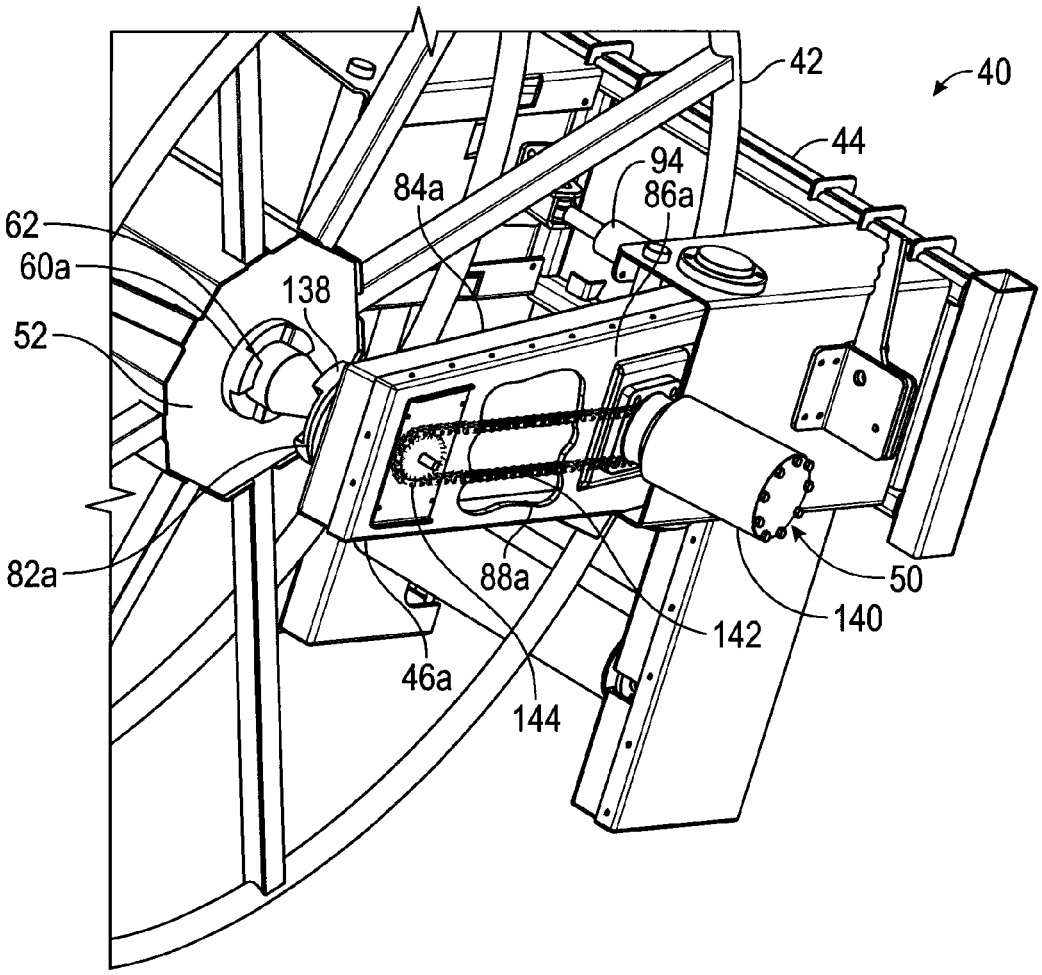
FIG. 9 is a partially cutaway, front perspective view of the apparatus illustrating a drive assembly.

Referring to FIGS. 2, 8, and 9, the hose reel 42 has a central hub 52 with a substantially cylindrical or substantially polyhedron shape. A plurality of spokes 54 may extend radially from each end of the central hub 52 so as to support a pair of outer rims 56*a*, 56*b* and define a hose receiving space 57. The central hub 52 may be hollow and have a slot 58 for receiving the coupler end of the hose 41 (as shown in FIG. 8), for example. The central hub 52 may have one or more connection members 60*a*, 60*b* on either end of the hub 52. In one embodiment, one of the connection members 60*a* may be substantially conically or frusto-conically shaped, and the other connection member 60*b* may be substantially conically or frusto-conically shaped. In addition, at least one of the connection members 60*a* may be provided with drive member 62 for engagement with the drive assembly 50 in a manner to be described in more detail below. In one embodiment, the drive member 62 may be in the form of a plurality of teeth (FIG. 9)

While the hose reel 42 described and illustrated herein effectively supports a length of flat hose, such as a length of 600 feet, it will be appreciated that the hose reel may be formed in a variety of shaped and sizes so long as the hose reel functions in accordance with the inventive concepts disclosed herein.

Figure 10:
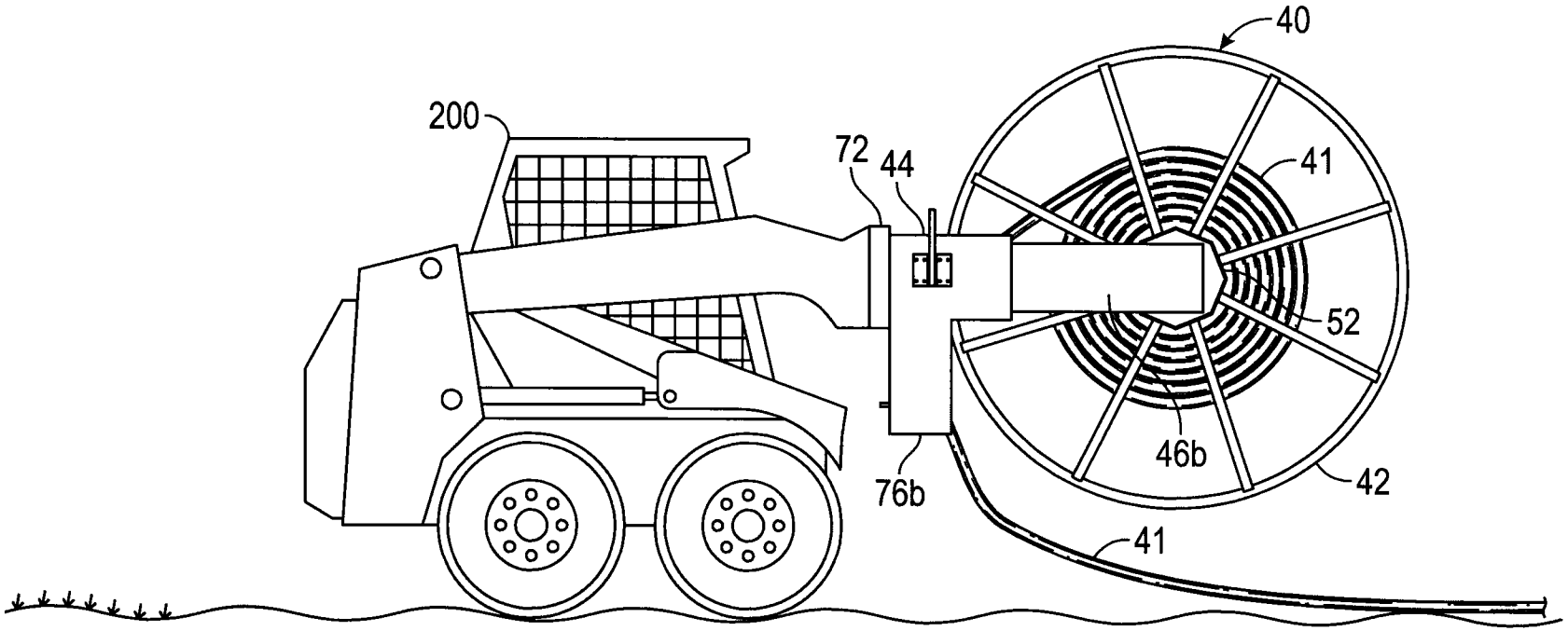
FIG. 10 is a side elevational view of the apparatus shown mounted on a piece of power equipment.

Turning to FIGS. 3-7, the base 44 supports the arms 46*a* and 46*b* and the hose tensioning assembly 48. In one embodiment, the base 44 may have a back plate portion 72, a pair of arm receiving portions 74*a*, 74*b*, and a pair of vertical portions 76*a*, 76*b* for supporting the hose tensioning assembly 48. However, it will be understood that the base 44 of the apparatus 40 may be configured in any suitable form capable of supporting the pair of opposed arms 46*a*, 46*b*, the hose tensioning assembly 48, the drive assembly 50, and the hose reel 42. The back plate portion 72 may be configured for attachment to a piece of power equipment 200 (as shown in FIG. 10), such as a front end loader, a skid steer loader, a track loader, a tractor, construction equipment, or the like. The attachment configuration for such power equipment 200 is well known to those having ordinary skill in the art and, as such, will not be further described herein. In another embodiment, the base 44 may be formed as a part of the piece of power equipment such that the piece of power equipment serves as the base.

The opposed arms 46*a*, 46*b* each have a proximal end 78*a*, 78*b* and a distal end 80*a*, 80*b* and may each have a reel support member 82*a*, 82*b* near the distal end 80*a*, 80*b* of each arm 46*a*, 46*b*. In one embodiment, the arms 46*a*, 46*b* may include an inner panel 84*a*, 84*b* and an outer panel 86*a*, 86*b* connected to one another in a way to cooperate to define an interior arm compartment 88*a*, 88*b* (FIG. 9).

One or both of the arms 46*a*, 46*b* is moveable such that the arms 46*a*, 46*b* are moveable relative to one another between an engaged position (FIGS. 8 and 10) and a non-engaged position (FIGS. 1 and 9). In the engaged position, the arms 46*a*, 46*b* are positioned so that the reel support members 82*a*, 82*b* are supportingly engaged with the central hub 52 of the hose reel 42. In the non-engaged position, the arms 46*a*, 46*b* are positioned so that the reel support members 82*a*, 82*b* are disengaged from the central hub 52 of the hose reel 42. The arms 46*a*, 46*b* may be pivotally connected to the base 44 such that the reel support members 82*a*, 82*b* are moveable in a to-and-fro relationship relative to one another.

Figure 4:
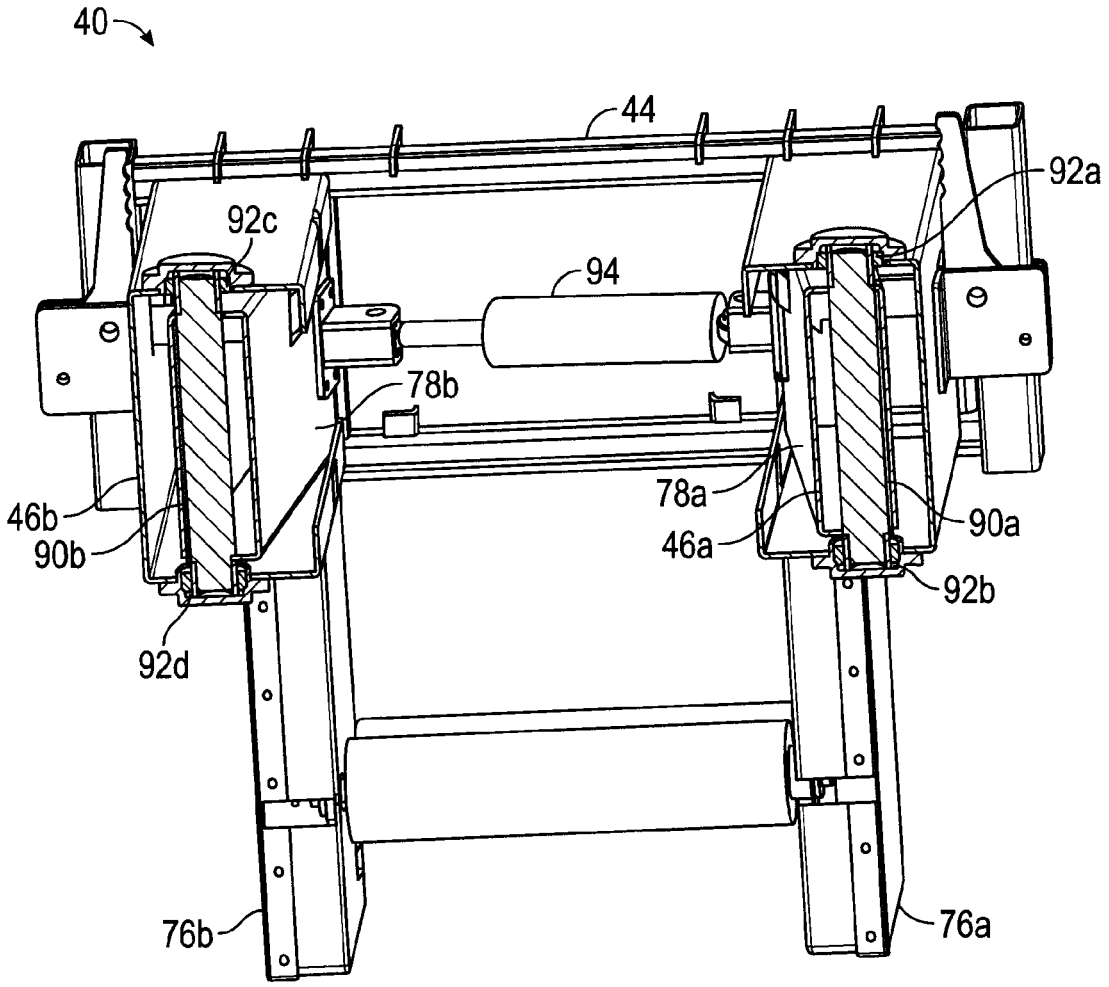
FIG. 4 is a perspective, cross-sectional view taken along line 4-4 of FIG. 3.

As illustrated in FIG. 4, the arms 46*a*, 46*b* may be pivotally connected to the base 44 by means of shafts 90*a*, 90*b* rotating on one or more bearings 92*a*-92*d*. In one embodiment, pivotal motion is provided to the arms 46*a*, 46*b* by at least one cylinder 94 connected to the proximal ends 78*a*, 78*b* of the arms 46*a*, 46*b*. In this example, when the cylinder 94 is extended, one or both of the proximal ends 78*a*, 78*b* of the arms 46*a*, 46*b* are moved away from one another, causing the arms 46*a*, 46*b* to pivot on the shafts 90*a*, 90*b* and the distal ends 80*a*, 80*b* of the arms 46*a*, 46*b* to move towards one another, such as toward the engaged position with the hose reel 42. Likewise, when the cylinder 94 is retracted, one or both of the proximal ends 78*a*, 78*b* of the arms 46*a*, 46*b* are moved toward one another, causing the arms 46*a*, 46*b* to pivot on the shafts 90*a*, 90*b* and the distal ends 80*a*, 80*b* to move away from one another, such as toward the non-engaged position. Of course, it will be understood that the arms 46*a*, 46*b* may be moved by other means and/or in other configurations. Nonexclusive examples include the arms 46*a*, 46*b* moving independently from one another and one arm 46*a* moving while another arm 46*b* remains stationary.

The cylinder 94 may be powered by any suitable hydraulic power system (not shown). The cylinder 94 may be powered by the piece of power equipment 200. Because the use of hydraulic circuits as well as their various components is well known in the art, the hydraulic hosing and components used in the present invention have been omitted from the drawings for the sake of clarity.

Figure 5:
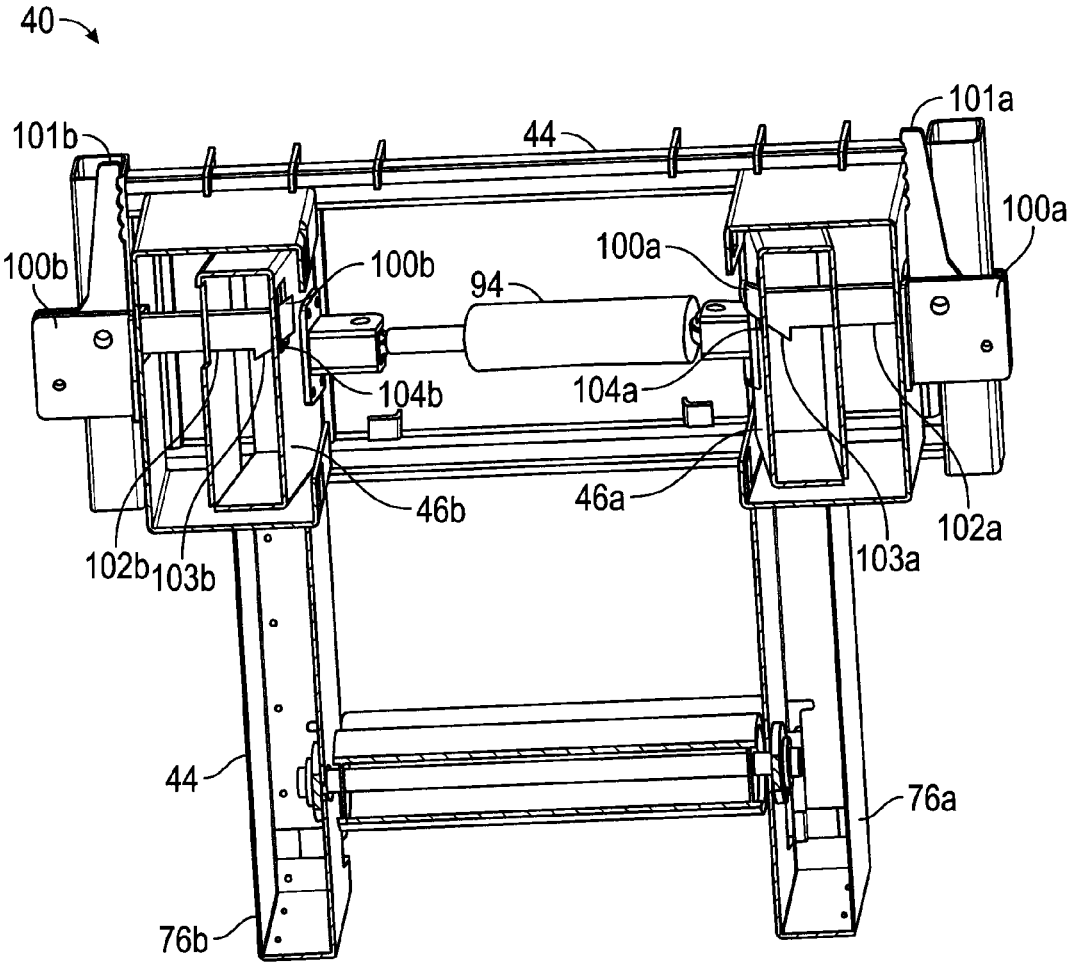
FIG. 5 is a perspective, cross-sectional view taken along line 5-5 of FIG. 3.

As best illustrated in FIG. 5, the apparatus 40 may include a pair of safety latches 100*a*, 100*b* to secure the arms 46*a*, 46*b* in the engaged position. The safety latches 100*a*, 100*b* may be connected to the base 44 in a way to be selectively engageable with the arms 46*a*, 46*b*, respectively, to support the arm 46*a*, 46*b* in the engaged position. In one embodiment, the safety latches 100*a*, 100*b* include an L-shaped structure defining a handle portion 101*a*, 101*b* and a latching portion 102*a*, 102*b*. The safety latches 100*a*, 100*b* are pivotally connected to the base so that the latching portion 102*a*, 102*b* may be moved out of engagement (as illustrated in FIG. 5) with the arms 46*a*, 46*b* by pulling the handle portion 101*a*, 101*b* and causing the latching portion 102*a*, 102*b* to travel upwardly in the slots 104*a*, 104*b* and disengage the arms 46*a*, 46*b*. With the arms 46*a*, 46*b* rotated to the engaged position, a hook 103*a*, 103*b* on the latching portion 102*a*, 102*b* may capture a portion of the arms 46*a*, 46*b* to secure the arms 46*a*, 46*b* in the engaged position.

Figure 6:
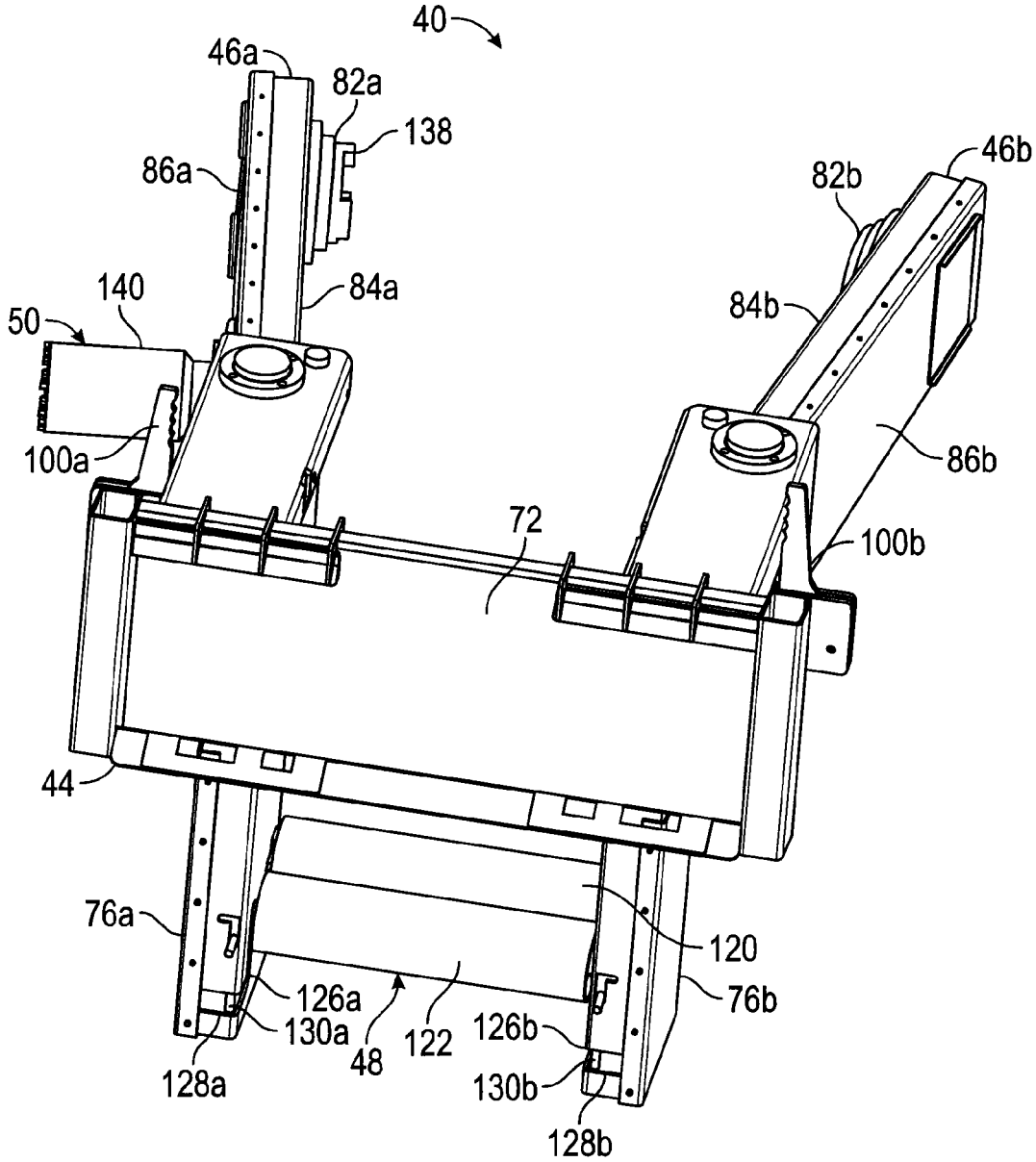
FIG. 6 is a rear perspective of the apparatus of FIG. 3.
Figure 7:
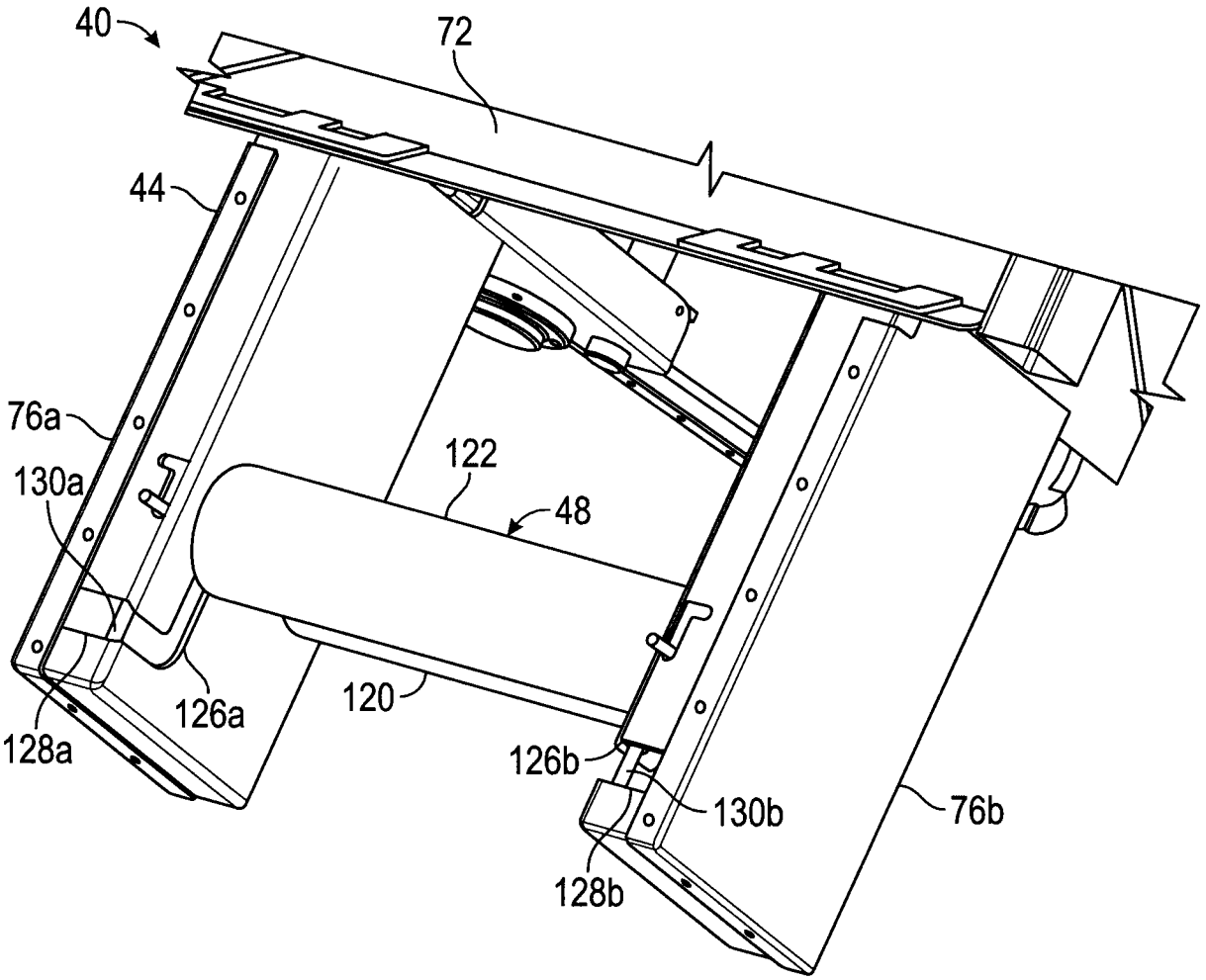
FIG. 7 is an enlarged, rear perspective view of the apparatus illustrating a tensioning assembly.

Referring now to FIGS. 6-8, the hose tensioning assembly 48 may include a first roller 120 and a second roller 122. The first roller 120 may be connected to the base 44 so that the first roller 120 extends between the vertical portions 76*a*, 76*b* of the base 44 in a fixed relationship to the base 44. The second roller 122 is connected to the base 44 in a parallel, vertically offset relationship with respect to the first roller 120. In addition, the second roller 122 is connected to the base 44 in a way to be vertically slideable relative to the first roller 120 so that when a hose, such as the hose 41 illustrated in FIG. 8, extends from the hose reel 42 and is positioned over the first roller 120 and around the second roller 122, the second roller 122 is movable relative to the first roller 120 such that the first roller 120 and the second roller 122 cooperate to apply tension to the hose 41 as the hose 41 is spooled onto the hose reel 42.

To permit the sliding movement of the second roller 122, the vertical portions 76*a*, 76*b* of the base 44 may be provided with opposing slots 126*a*, 126*b*. In one embodiment, the slots 126*a*, 126*b* may be substantially J-shaped and have open end 128*a*, 128*b* through which the second roller 122 may be detached from the base 44 for reasons to be discussed below. The hose tensioning assembly 48 may further include a pair of roller latches 130*a*, 130*b* connected to the base 44 to selectively close the open ends 128*a*, 128*b* of the slots 126*a*, 126*b* and thereby secure the second roller 122 to the vertical portions 76*a*, 76*b* of the base 44.

As shown in FIG. 9, the drive assembly 50 is supported by at least one of the arms 46*a*, 46*b* in a way that activation of the drive assembly 50 causes at least one of the reel support members 82*a*, 82*b* to rotate and thereby rotate the hose reel 42 when the arms 46*a*, 46*b* are in the engaged position. The reel support members 82*a*, 82*b* may be configured to drive the hub 52 of the hose reel 42. For example, the reel support member 82*a* may have teeth 138 to engage mating teeth 62 of the connection member 60*a* of the hub 52.

The drive assembly 50 may include a drive motor 140 mounted to at least one of the arms 46*a*, 46*b* as well as a linkage 142 housed in the interior arm compartment 88*a*, 88*b* of the arm 46*a*, 46*b* and operably connected to the drive motor 140 and at least one of the reel support members 82*a*, 82*b*, such as through at least one sprocket 144. The drive motor 140 supplies rotative forces to the linkage 142 in at least one of the arms 46*a*, 46*b* through the at least one sprocket 144 and at least one of the reel support members 82*a*, 82*b* to provide rotation to the hub 52 of the hose reel 42. Any drive motor 140 of suitable power to rotate the hose reel 42 may be used. The drive motor 140 may be powered through an exterior source. When the drive assembly 50 is not activated and the arms 46*a*, 46*b* are in the engaged position, the hose reel 42 may be allowed to be in a free-wheeling state such that the hose reel 42 may be freely rotated.

The apparatus 40 may be controlled and/or powered from the piece of power equipment 200, as illustrated in FIG. 10. For example, the piece of power equipment 200 may be connected to the apparatus 40 for activating and deactivating the drive assembly 50 and moving the arms 46*a*, 46*b*, such that an operator of the power equipment 200 may operate the apparatus 40 with controls of the power equipment 200. The connections between the power equipment 200 and the apparatus 40 may be hydraulic and/or electrical. As this type of control is well known in the art, the connections and control systems will not be further explained herein.

In use, the apparatus 40 may be used to deploy and/or retrieve lay-flat hose 41. Initially, a piece of power equipment 200, such as a skid steer, may attach to the back plate portion 72 of the base 44 of the apparatus 40 while the arms 46*a*, 46*b* of the apparatus 40 are in the non-engaged position and so not engaged with the hose reel 42. Hydraulic and/or electrical connections may be made between the piece of power equipment 200 and the apparatus 40, so as to provide power and control of the drive assembly 50 and to the arms 46*a*, 46*b*.

The piece of power equipment 200 may be used to maneuver the arms 46*a*, 46*b* to either side of the central hub 52 of the hose reel 42. The arms 46*a*, 46*b* are moved to the engaged position so that the reel support members 82*a*, 82*b* are supportingly engaged with the central hub 52 of the hose reel 42. The safety latches 100*a*, 100*b* may be engaged to secure the arms 46*a*, 46*b* in the engaged position. The piece of power equipment 200 may be used to move the apparatus 40 to the desired location for hose deployment/retrieval.

For hose deployment, typically the drive assembly 50 is not activated, and the reel support members 82*a*, 82*b* are allowed to be in a free state such that the hose reel 42 may be freely rotated to deploy the hose 41 while the piece of power equipment 200 moves forward and/or backward. In most cases the hose tensioning assembly 48 is not needed for deployment of the hose 41 since the weight of the hose 41 and the movement of the piece of power equipment 200 unspools the hose 41 from the freely rotating hose reel 42. Once the hose 41 is deployed from the hose reel 42, the safety latches 100*a*, 100*b* may be disengaged and the arms 46*a*, 46*b* moved to the non-engaged position, thus releasing the hose reel 42. This process may be repeated with a plurality of hose reels 42 to form the requisite length of hose 41.

To begin hose retrieval, the arms 46*a*, 46*b* are moved to the engaged position and the reel support members 82*a*, 82*b* are supportingly engaged with the central hub 52 of the hose reel 42. The safety latches 100*a*, 100*b* may be moved into place to secure the arms 46*a*, 46*b* in the engaged position. As shown in FIG. 8, the end of the hose 41 is looped over the central hub 52 of the hose reel 42. The end of the hose 41, and/or a coupler 160 at the end of the hose 41, may be placed through the slot 58 and into the central hub 52 of the hose reel 42, or similarly started on the hose reel 42 (for example, by rotating the hose reel 42). The hose 41 is threaded through the hose tensioning assembly 48 by looping the hose 41 around the second roller 122 and over the first roller 120, as illustrated in FIG. 8.

To facilitate threading of the hose coupling 160 through the hose tensioning assembly 48, the second roller 122 can be detached from the base 44 by opening the roller latches 130*a*, 130*b* so that the roller latches 130*a*, 130*b* are removed from the slots 126*a*, 126*b*. With the slots 126*a*, 126*b* exposed, the ends of the second roller 122 may be slid out of the open ends 128*a*, 128*b* of the slots 126*a*, 126*b*. A loop may then be formed in the hose 41 and the second roller 122 inserted through the loop and reattached to the base 44 while the free end of the hose 41 is looped over the first roller 120, as shown in FIG. 8.

When the hose reel 42 is rotated to spool the hose 41 on the hub 52 of the hose reel 42 (such as when the drive assembly 50 is activated), tension is created on the hose 41 between the first and second rollers 120, 122 and the hub 52. The second roller 122 is slideably movable on the base 44, for example, by moving up and down in the slots 126*a*, 126*b*. The second roller 122 moves vertically based on the amount of tension on the hose 41 between the hub 52 of the hose reel 42 and the first and second rollers 120, 122. The hose 41 is therefore kept under sufficient tension so as to spool the hose 41 onto the hose reel 42 without substantial sagging of the hose 41 on the hub 52 of the hose reel 42 as the piece of power equipment 200 travels along a path defined by the length of the hose 41. The process may be repeated with a plurality of hose reels 42 to retrieve multiple sections of hose 41.

Upon retrieval of the hose 41, the apparatus 40 in combination with the piece of power equipment 200 may be used to load the hose reel 42 on a rack, a trailer, trailer bed, truck, or other transport equipment. When the hose reel 42 is in the appropriate position on the transport equipment, the arms 46*a*, 46*b* may be moved to the non-engaged position, thereby releasing the hose reel 42. Likewise, the piece of power equipment 200 may be used to unload the hose reel 42 after transportation.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and claimed herein. While the apparatus 40 has been described in the context of deploying and retrieving hose used in oil and gas production, it will be understood the apparatus 40 may be used in any environment requiring deployment or retrieval of hose.

What is claimed is:

1. An apparatus comprising:

a hose reel having a central hub;

a base;

a pair of opposed arms mounted to the base, each of the arms having a reel support member near a distal end thereof, at least one of the arms being moveable such that the arms are moveable relative to one another between an engaged position wherein the arms are positioned so that the reel support members are supportingly engaged with the central hub of the hose reel, and a non-engaged position wherein the arms are positioned so that the reel support members are disengaged from the central hub of the hose reel;

a hose tensioning assembly supported by the base, the hose tensioning assembly comprising:

a first roller connected to the base; and a second roller connected to the base in a parallel, vertically offset relationship with respect to the first roller, and the second roller being vertically slideable relative to the first roller such that when a hose extending from the hose reel is positioned over the first roller and around the second roller, the second roller moves relative to the first roller such that the first roller and the second roller cooperate with one another to provide tension to the hose as the hose is spooled onto the hose reel; and a drive assembly supported by at least one of the opposed arms in a way that activation of the drive assembly causes at least one of the reel support members to rotate and thereby rotate the hose reel when the arms are in the engaged position.

2. The apparatus of claim 1, wherein the second roller is detachable from the base.

3. The apparatus of claim 1, wherein each of the arms is pivotally connected to the base.

4. The apparatus of claim 1, further comprising at least one safety latch connected to the base, the safety latch selectively engageable with the arm to support the arm in the engaged position.

5. The apparatus of claim 1, wherein the drive assembly comprises:

a motor mounted to at least one of the arms; and a linkage housed in the arm, the linkage operably connecting the motor to at least one of the reel support members.

6. The apparatus of claim 1, wherein the base includes a pair of opposing slots in which the second roller is supported.

7. The apparatus of claim 6, wherein the slots are substantially J-shaped and have an open end.

8. The apparatus of claim 7, further comprising a pair of latches connected to the base to selectively close the open ends of the slots.

9. The apparatus of claim 1, wherein the base is attachable to a piece of power equipment.

10. An apparatus comprising:

a hose reel having a central hub;

a base;

a pair of opposed arms mounted to the base, each of the arms having a reel support member near a distal end thereof for engaging the central hub of the hose reel;

a hose tensioning assembly supported by the base, the hose tensioning assembly comprising:

a first roller connected to the base; and a second roller connected to the base in a parallel, vertically offset relationship with respect to the first roller, and the second roller being vertically slideable relative to the first roller such that when a hose extending from the hose reel is positioned over the first roller and around the second roller, the second roller moves relative to the first roller such that the first roller and the second roller cooperate with one another to provide tension to the hose as the hose is spooled onto the hose reel; and a drive assembly supported by at least one of the opposed arms in a way that activation of the drive assembly causes at least one of the reel support members to rotate and thereby rotate the hose reel when the arms are in an engaged position.

11. An apparatus comprising:

a base;

a pair of opposed arms mounted to the base, each of the arms having a reel support member near a distal end thereof, at least one of the arms being moveable such that the arms are moveable relative to one another between an engaged position wherein the arms are positioned so that the reel support members are supportingly engaged with a central hub of a hose reel, and a non-engaged position wherein the arms are positioned so that the reel support members are disengaged from the central hub of the hose reel;

a hose tensioning assembly supported by the base, the hose tensioning assembly comprising:

a first roller connected to the base; and a second roller connected to the base in a parallel, vertically offset relationship with respect to the first roller, and the second roller being vertically slideable relative to the first roller such that when a hose extending from the hose reel is positioned over the first roller and around the second roller, the second roller moves relative to the first roller such that the first roller and the second roller cooperate with one another to provide tension to the hose as the hose is spooled onto the hose reel; and a drive assembly supported by at least one of the opposed arms in a way that activation of the drive assembly causes at least one of the reel support members to rotate and thereby rotate the hose reel when the arms are in the engaged position.

* * * * *